United States Patent [19]

Baumgartner et al.

[11] 4,121,353

[45] Oct. 24, 1978

[54] COLLAPSIBLE, FLEXIBLE HAIR DRYING HOOD

[76] Inventors: Erich Rudolf Baumgartner, Tiroler Platz 4; Peter Doehler, Kaulbachstrasse 59, both of Munich, Fed. Rep. of Germany, 8000

[21] Appl. No.: 770,550

[22] Filed: Feb. 22, 1977

[30] Foreign Application Priority Data

Feb. 20, 1976 [DE] Fed. Rep. of Germany ..... 2606967

[51] Int. Cl.[2] ..... A45D 20/25

[52] U.S. Cl. ..... 34/99

[58] Field of Search ..... 34/96–101, 34/239, 90, 243 R

[56] References Cited

U.S. PATENT DOCUMENTS 3,044,183 7/1962 Mauch et al. ..... 34/99

3,113,848 12/1963 Clark, Jr. ..... 34/99

FOREIGN PATENT DOCUMENTS 682,346 2/1930 Fed. Rep. of Germany ..... 34/99

*Primary Examiner*—Kenneth W. Sprague
*Assistant Examiner*—James C. Yeung
*Attorney, Agent, or Firm*—Griffin, Branigan & Butler

[57] ABSTRACT

A collapsible flexible hair drying hood includes a base air chamber communicating with a blower and flexible hoselike hood portions. The hoselike hood portions extend upwardly from the base air chamber when the hair drying hood is in use. The hose-like hood portions define nozzle orifices for blowing hot air from the blower onto hair and elongated slots therebetween for communicating the interior of the hood with the free environment.

6 Claims, 3 Drawing Figures

COLLAPSIBLE, FLEXIBLE HAIR DRYING HOOD

FIELD OF THE INVENTION

This invention relates to a folding, collapsible and flexible hair drying hood comprising a blower simultaneously providing a drying air stream directed through nozzle orifices into the interior of said hood and blowing up and inflating air chambers of said hood to erect the hood.

DISCUSSION OF PRIOR ART

Such a hair drying hood is known from e.g. German Offenlegungsschrift No. 2 350 741 or from German Gebrauchsmuster No. 7 306 125.

The use of the known hair drying hoods has shown that in some cases the drying results are unsatisfactory and that the drying procedure is of a relatively long duration while at the same time the operative temperatures give unpleasant feeling to the user and possibly extert a detrimental effect on the scalp.

SUMMARY OF THE INVENTION

The object of the invention is to solve the problem of providing a hair drying hood of the above type so as to achieve better drying results.

This problem is solved according to the invention in that perforations communicating the interior of said hood with the free environment are provided adjacent said nozzle orifices.

Surprisingly, it turned out that a closed hood body is by no means a proviso for erecting the hood or, still better, for a floating of the overall hood over the head and head-dress of the user. Said perforations rather provide an increased curvature of the flexible walls of said hood and thus an enhanced stability whilst a constant internal pressure prevails within said air chambers.

At the same time it is achieved that hot moisture-saturated air can rapidly escape from the interior of said hood from the space between the user's head dress and the inner walls of said hood toward the free environment so that cool, relatively dry air reaches the still wet hair thereby improving the air circulation. The test results show that a hair drying hood made in this manner reduces the drying time so much as 50%. Thus, for a desired constant drying time the blower output, when using the hair drying hood proposed here, can be decreased so that a smaller blower can be used whereby the overall air drying hood becomes more handy.

According to a preferred embodiment, said perforations have the shape of slots having a length and extending in a manner such as to subdivide said hood into a plurality of substantially mutually adjacent strips or hose-like hood portions which are running from a hood base forming an air feed duct and which are provided with nozzle orifices.

This structure provides a folding flexible hair drying hood showing a certain remote resemblance to the well-known hairdresser's hoods in which the nozzle orifices are provided in rows in individual metallic tubes of a plurylity of such tubes encircling the user's head.

According to the present invention it was discovered that the subdividing or breaking up of the hood body of a flexible hair drying hood, which in general already encloses the user's head more closely than the rigid hair drying hoods used expecially in hairdresser's shops, leads to an improvement of the drying results and simultaneously permits a decrease of the temperature within the interior of the hood in a highly desirable way whereby a detriment to the scalp, even in areas in which the hair drying hood might occasionally come into very close engagement with the user's head-dress, is reliably avoided.

BRIEF DESCRIPTION OF THE DRAWINGS

A number of exemplary embodiments are described in detail hereinafter with reference to the attached drawings in which.

DESCRIPTION OF PREFERRED EMBODIMENTS

Figure 1:
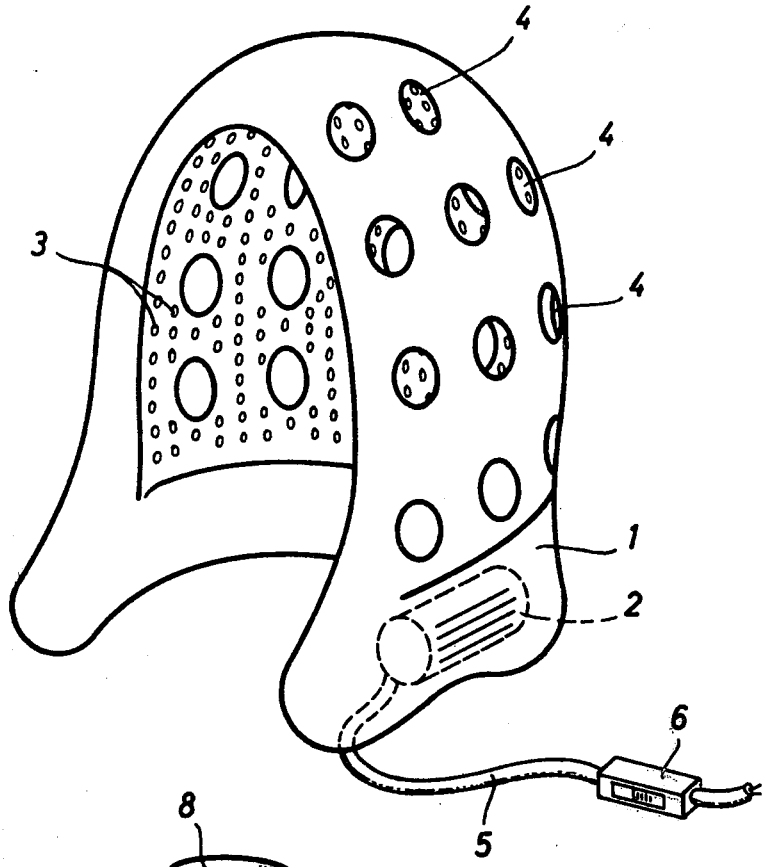
FIG. 1 shows a perspective view of a collapsible, flexible hair drying hood in simplified manner.

In or at the hood base 1 formed of an inflatable bead is disposed a blower 2 blowing up air chambers of the hair drying hood so that this hood will be erected and constitute a comparatively shape-unvarying hood body which on its inner side has a plurality of nozzle orificies 3 from which a drying air stream is issued in the direction of the interior of said hood. Adjacent said nozzle orifices are disposed perforations 4 which communicate the interior of said hood with the free environment and which, in the embodiment of FIG. 1, are formed so that the flexible inner wall and the flexible outer wall of said hood are heat-sealed with each other along the edge of the perforations 4. It is to be noted that details of the hair drying hood are omitted from FIG. 1, e.g. control means for keeping the temperature constant, adjustment means for selecting a predetermined air temperature and the like. Merely a cable 5 leading to blower 2 and a switch 6 are shown in FIG. 1.

Figure 2:
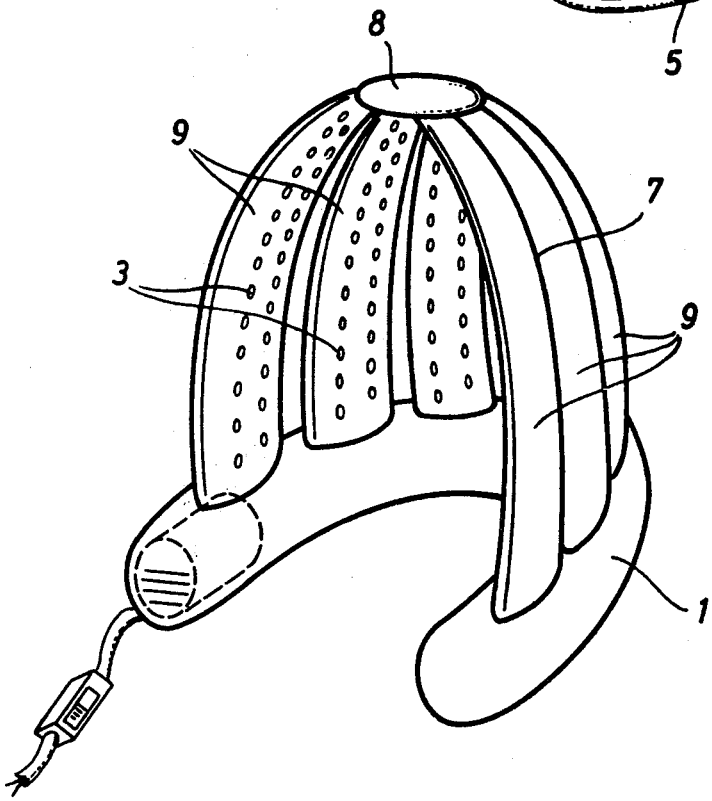
FIG. 2 shows a view similar to that of FIG. 2 but of another embodiment.

In the embodiment of FIG. 2 the perforations have the shape of slots 7 extending from the hood base 1 to the hood apex 8 formed of a flexible lid or cover member provided with an air outlet aperture. Slots 7 subdivide said hood body into a plurality of arcuate strip or hose-like hood portions 9 which extend side-by-side and to which drying air can be fed via the hood base 1 comprising an air duct, and which are provided with rows of nozzle orifices 3 on the side facing the interior of said hood.

Figure 3:
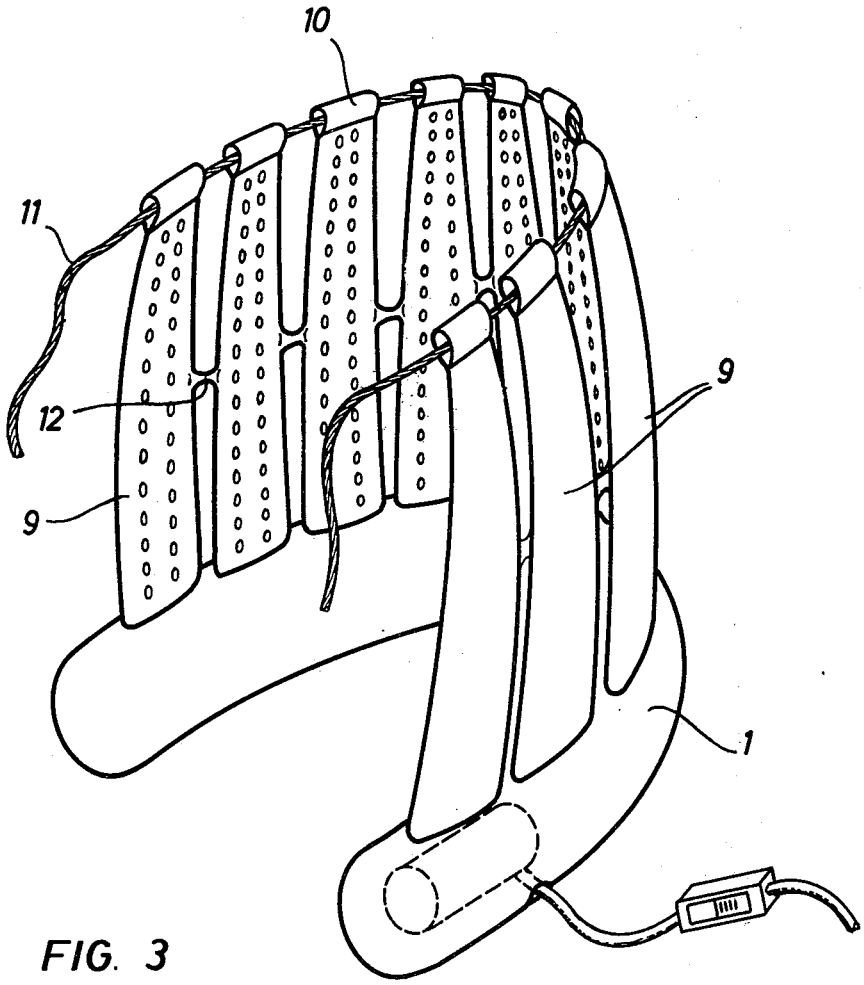
FIG. 3 shows another perspective view of a preferred embodiment of a flexible hair drying hood.

The embodiment of FIG. 3 is formed in a manner similar to that in which the embodiment of FIG. 2 is formed, yet here said strip or hose-like hood portions 9 are not formed integral with a cover member but in the upper portion of the hood comprise free ends which, as at 10, are loop-shaped so that a length of a band or string 11 may extend through the loops and so that when the strip or hose-like hood portions 9 are drawn together this forms the definite configuration of said hood. In this manner it is possible to adjust the flexible hair drying hood to any size and shape of user's heads or head-dresses. Between said hood portions 9 are provided thin flexible webs or ridges 12 preventing said hood portions 9 from being dislocated.

It is to be noted that the hood base 1 must not necessarily have the configuration shown in the drawings but may also have another shape.

What we claim is:

1. A collapsible flexible hair drying hood assembly of the type having a blower simultaneously providing a drying air stream directed through nozzle orifices into the interior of a flexible hood member and inflating air chambers of said hood member to erect the hood member, said hood member comprising a flexible base air chamber communicating with said blower and flexible hoselike hood portions communicating with said base air chamber, said flexible hoselike hood portions defining said nozzle orifice, said flexible hose-like hood portions extending upwardly from said base when said hood is in use to define elongated slots communicating the interior of said hood with the free environment and being situated adjacent said nozzle orifices, said slots extending in a manner to subdivide said hood into a plurality of substantially mutually adjacent hoselike hood portions provided with nozzle orifices, said hoselike hood portions running from said hood base to a hood apex.

2. The hair drying hood according to claim 1 wherein said hood portions terminate into a substantially rigid cover member within the hood apex.

3. The hair drying hood according to claim 1 wherein said hood portions terminate into a substantially flexible cover member within the hood apex.

4. The hair drying hood according to claim 2 wherein said cover member has an apex outlet opening directed to the outer side of said hood.

5. The hair drying hood according to claim 3, wherein said cover member has an apex outlet opening directed to the outer side of said hood.

6. The hair drying hood according to claim 1, wherein said hood portions at their upper ends are not formed integral with each other within the apex region but are adapted to be drawn together via a connecting string.

* * * * *